US008936001B2

(12) United States Patent
Ito

(10) Patent No.: US 8,936,001 B2
(45) Date of Patent: Jan. 20, 2015

(54) VALVE TRAIN DEVICE AND CYLINDER HEAD PROVIDED WITH SAME

(75) Inventor: Keisuke Ito, Shizuoka-Ken (JP)

(73) Assignee: Suzuki Motor Corporation, Hamamatsu-shi, Shizuoka-Ken (JP)

( * ) Notice: Subject to any disclaimer, the term of this patent is extended or adjusted under 35 U.S.C. 154(b) by 147 days.

(21) Appl. No.: 13/400,438

(22) Filed: Feb. 20, 2012

(65) Prior Publication Data

US 2012/0210965 A1 Aug. 23, 2012

(30) Foreign Application Priority Data

Feb. 22, 2011 (JP) ..... 2011-036099

(51) Int. Cl.

| | |
|---|---|
| ***F01L 1/14*** | (2006.01) |
| ***F01L 1/06*** | (2006.01) |
| ***F01L 13/00*** | (2006.01) |
| ***F01L 1/46*** | (2006.01) |
| ***F01L 3/10*** | (2006.01) |
| *F02B 61/02* | (2006.01) |

(52) U.S. Cl.

CPC ..... *F01L 13/0005* (2013.01); *F01L 1/143* (2013.01); *F01L 1/462* (2013.01); *F01L 3/10* (2013.01); *F01L 2001/467* (2013.01); *F02B 61/02* (2013.01)

USPC ..... 123/90.48; 123/90.32

(58) Field of Classification Search

USPC ..... 123/90.32, 90.48

See application file for complete search history.

(56) References Cited

U.S. PATENT DOCUMENTS

| | | | | | |
|---|---|---|---|---|---|
| 4,917,056 | A * | 4/1990 | Yagi et al. | ..... | 123/90.16 |
| 5,361,734 | A * | 11/1994 | Shirai | ..... | 123/90.16 |
| 5,558,052 | A * | 9/1996 | Schwarzenthal et al. | .. | 123/90.16 |
| 5,603,294 | A | 2/1997 | Kawai | | |
| 5,673,658 | A * | 10/1997 | Allmendinger | ..... | 123/90.12 |
| 5,709,180 | A | 1/1998 | Spath | | |
| 7,370,617 | B2 * | 5/2008 | Maehara et al. | ..... | 123/90.27 |
| 2003/0094324 | A1 | 5/2003 | Huang | | |

FOREIGN PATENT DOCUMENTS

| | | | |
|---|---|---|---|
| DE | 44 33 742 | A1 | 4/1995 |
| DE | 195 44 527 | A1 | 6/1996 |
| DE | 10 2006 053 961 | A1 | 6/2007 |
| EP | 0 668 436 | A1 | 8/1995 |

(Continued)

OTHER PUBLICATIONS

European Search Report dated Dec. 12, 2012 for corresponding European Patent Application No. 12156314.2.

*Primary Examiner* — Thomas Denion
*Assistant Examiner* — Steven D Shipe
(74) *Attorney, Agent, or Firm* — Barnes & Thornburg LLP

(57) ABSTRACT

A valve train device installed in a cylinder head of an engine and driven by a camshaft including a valve unit having an intake valve and an exhaust valve communicated with a combustion chamber of an engine, each of the intake valve and exhaust valve having a linearly extending stem portion and driven in an extending direction of the stem portion; a valve lifter disposed between one end side of the stem portion located apart from the combustion chamber and the camshaft to transmit power from the camshaft to the valve unit; a lost motion unit that interrupts power transmission from the valve lifter to the valve unit; a first spring urging the valve unit in a direction to close the intake valve or exhaust valve; and a second spring having a diameter lager than that of the first spring and urging the lost motion unit against the valve lifter.

4 Claims, 8 Drawing Sheets

(56) References Cited

FOREIGN PATENT DOCUMENTS

| | | | |
|---|---|---|---|
| EP | 1 277 923 | A1 | 1/2002 |
| EP | 1 221 541 | A2 | 7/2002 |
| EP | 1 398 263 | A1 | 3/2004 |
| EP | 1 495 956 | A2 | 1/2005 |
| EP | 1 495 956 | A3 | 1/2005 |
| EP | 2 253 530 | A1 | 11/2010 |
| GB | 2 422 717 | A | 8/2006 |
| JP | 2000087711 | | 3/2000 |
| JP | 2002-037167 | A | 2/2002 |

* cited by examiner

VALVE TRAIN DEVICE AND CYLINDER HEAD PROVIDED WITH SAME

PRIORITY CLAIM

This patent application claims priority to Japanese Patent Application No. 2011-036099, filed 22 Feb. 2011, the disclosure of which is incorporated herein by reference in its entirety.

BACKGROUND

1. Field

Disclosed embodiments relate to a valve train device installed in a cylinder head of an engine, more particularly, to a valve train device including a valve resting mechanism, and also relates to a cylinder head of the engine provided with the valve train device.

2. Related Art

A conventionally known valve train device of an engine of, for example, a vehicle, includes a valve resting mechanism that holds a poppet valve (intake valve and exhaust valve) in a closed position irrespective of an operation of a camshaft of an engine, for example, as disclosed in Japanese Patent Application Laid-Open Publication No. 2000-87711 (Patent Document 1). The valve train device described in Patent Document 1 is mounted to a cylinder head of the engine and configured to transmit power from a camshaft to the poppet valve via a valve tappet. The valve tappet includes a lost motion unit that temporarily interrupts power transmission from the camshaft to the poppet valve.

The lost motion unit is constructed so as to be hydraulically switchable between an interlocking state and a non-interlocking state between the valve tappet and an upper end of a stem portion of the poppet valve. The lost motion unit transmits a vertical motion of the valve tappet in accordance with rotation of the camshaft to the poppet valve, and operates to open or close the poppet valve, for example, during middle speed rotation or high speed rotation of the engine. Furthermore, the lost motion unit temporality interrupts power transmission to the poppet valve irrespective of the vertical motion of the valve tappet, for example, during low speed rotation of the engine, and holds the poppet valve in the closed position.

However, since the valve train device described above includes the lost motion unit between the camshaft and the poppet valve, a size or dimension of the valve train device is increased in a driving direction of the poppet valve, which may result in increase in sizes of components such as a cylinder head and a head cover that house the valve train device, and hence, increasing height of the entire engine. This makes it difficult to ensure an installation space for the engine, and increases weight of the engine, and furthermore, the increase in the size or dimension of the engine further requires production of a dedicated component, which may result in increasing in the production costs.

SUMMARY

Disclosed embodiments provide a valve train device provided with a lost motion unit without increasing height of an engine of a vehicle, and also provide a cylinder head of an engine equipped with such valve train device.

One disclosed embodiment provides a valve train device installed in a cylinder head of an engine and driven by a camshaft of the engine, the valve train device includes: a valve unit including an intake valve and an exhaust valve communicated with a combustion chamber of an engine, each of the intake valve and exhaust valve having a linearly extending stem portion and driven in an extending direction of the stem portion to open/close an intake port or exhaust port communicating with the combustion chamber of the engine; a valve lifter disposed between one end side of the stem portion located apart from the combustion chamber and the camshaft so as to transmit power from the camshaft to the valve unit; a lost motion unit that interrupts power transmission from the valve lifter to the valve unit; a first spring urging the valve unit in a direction to close the intake valve or exhaust valve; and a second spring having a diameter lager than that of the first spring and urging the lost motion unit against the valve lifter, in which another end side of the second spring is disposed at a portion closer to one end side of the stem portion than a location of another end side of the first spring with respect to the cylinder head.

According to this configuration, the narrow portion of the installation portion of the valve train device in the cylinder head can be placed in a dead space near the fluid path of the cylinder head, thus contributing the absorption of an increase in size of the valve train device by the lost motion unit, and preventing an increase in height of the engine. Thus, an installation space for the engine can be ensured and the weight of the engine can be reduced.

Furthermore, it is not necessary to additionally locate a dedicated component due to an increase in height of the engine, thereby reducing production costs. The installed portion of the valve train device is narrow on the other end side of the stem portion, thereby preventing the valve train device from protruding from the dead space of the cylinder head into the fluid path.

In one disclosed embodiment of the above aspect, the following subject features are also provided.

It may be also desired that the first spring is installed in the cylinder head through the first spring seat, the second spring is installed in the cylinder head via the second spring seat, in which the first spring seat has an outer bearing surface portion that receives an end of the second spring on the other end side in the extending direction of the stem portion, and the second spring seat has an inner bearing surface portion that receives an end of the first spring on the other end side in the extending direction of the stem portion, and wherein the first spring has an end surface portion exposed between the first spring seat and the second spring seat.

According to the configuration and characters mentioned above with reference to the disclosed embodiment, since the end of the first spring having a diameter smaller than the second spring is disposed in the dead space near the fluid path of the cylinder head, thereby preventing or minimizing protrusion of each spring can be prevented from protruding into the fluid path or minimizing the protruding length therein, and an increase in height of the engine can be prevented with a simple configuration.

Furthermore, since the end side surface of the first spring is brought into contact with the cylinder head via a side surface portion of the spring seat, the surface of the first spring comes into slide contact with the side surface portion of the spring seat during driving of the valve, thereby reducing damage by wear in comparison with a configuration in which the surface of the first spring directly comes into slide contact with the cylinder head. In addition, the spring seat integrally holds the first spring and the second spring, thereby preventing dismounting or removal of the first spring and the second spring during assembling.

Still furthermore, since the side surface portion that connects the outer bearing surface portion and the inner bearing surface portion is not provided between the first spring seat and the second spring seat, and accordingly, the installation portion of the valve train device in the cylinder head is made to be further narrower on the other end side of the stem portion. Thus, even if a narrow dead space is formed near the fluid path of the cylinder head, protrusion of each spring into the fluid path can be prevented or minimized.

In another disclosed embodiment, there is also provided a cylinder head of an engine which includes: an intake port; an exhaust port; a valve unit including an intake valve and an exhaust valve to open/close the intake port and the exhaust port; and a valve train device that drives the valve unit, wherein the valve train device includes a cam shaft, a valve lifter driven by a cam mounted to the cam shaft to be integrally rotatable, a lost motion unit that interrupts power transmission from the valve lifter to the valve unit, a first spring urging the valve unit in a direction to close the intake valve or exhaust valve, and a second spring having a diameter lager than that of the first spring and urging the lost motion unit against the valve lifter, and wherein the cylinder head is provided with an inner bearing surface portion to which the first spring is fitted and an outer bearing surface portion to which the second spring is fitted, in which the outer bearing surface portion is positioned closer to the valve lifter than the inner bearing surface portion, and the inner bearing surface portion and the outer bearing surface portion have configuration such that a virtual line connecting an outer edge portion of the inner bearing surface portion and an outer edge portion of the outer bearing surface portion is substantially parallel to an inner peripheral wall surface of the intake port or exhaust port as viewed in an axial direction of the cam shaft.

The nature and further characteristic features of the present invention will be made clearer from the following descriptions made with reference to the accompanying drawings.

DESCRIPTION OF THE DISCLOSED EMBODIMENTS

Disclosed embodiments will be described hereunder with reference to the accompanying drawings. One disclosed embodiment of a valve train device herein specifically applied to an engine, i.e., cylinder head thereof, of a vehicle of a naked type motorcycle will be described, but the present invention is not limited to this disclosed embodiment and other modifications or alternations may be applied to an engine (engine unit) of motorcycles of other types, four-wheel vehicles, boats such as outboard motor, or the like. It is further to be noted that terms "upper", "lower", "right", "left" and like terms representing direction are used herein with reference to the illustration of the drawings as far as specific other description is not made.

Figure 1:
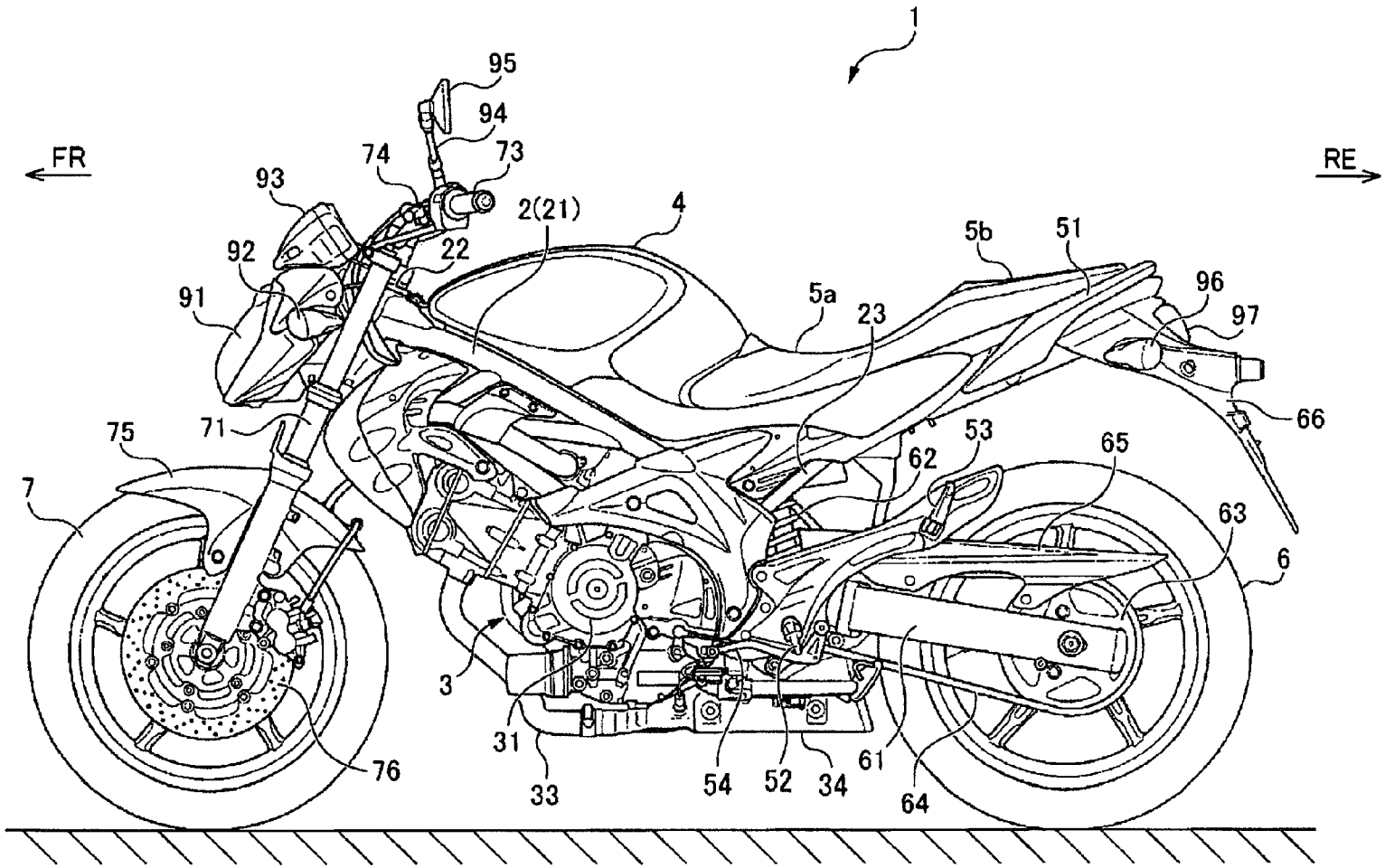
FIG. 1 is a left side view of a motorcycle provided with an engine unit having a valve train device according to one disclosed embodiment.

With reference to FIG. 1 showing a schematic outer configuration of a motorcycle, as a vehicle, provided with an engine according to one embodiment, a front side of a vehicle body is shown by an arrow FR and a rear of the vehicle body is shown by an arrow RE.

As shown in FIG. 1, a motorcycle 1 includes a vehicle body frame structure 2 made of steel or aluminum alloy, and components such as a power unit and an electric system are mounted thereto. A main frame 21 of the vehicle body frame structure 2 is laterally bifurcated rearward from a head pipe 22 at a front end and slopes rearward downward.

An engine unit 3 is suspended from a lower portion of the main frame 21. A fuel tank 4 is placed on an upper portion of the main frame 21. A driver seat 5*a* and a passenger seat 5*b* are connected to upper portions of a pair of left and right seat rails, not shown, connected to a rear portion of the main frame 21 on the rear of the fuel tank 4.

The seat rails extend rearward and upward from the rear portion of the main frame 21 and support the driver seat 5*a* and the passenger seat 5*b* together with reinforcing seat pillars 23. Handlebars 51 for the passenger are provided on left and right frame covers of the passenger seat 5*b*. Below the driver seat 5*a* and the passenger seat 5*b*, foot rests 52 and 53 are provided correspondingly in positions. A shift pedal 54 is provided in front of the driver foot rest 52 on the left side of the vehicle body and a brake pedal, not shown, for a rear wheel 6 is provided in front of the driver foot rest 52 on the right side of the vehicle body.

A pair of front forks 71 is laterally and swingably supported via a steering shaft mounted to the head pipe 22 on an upper side of the front portion of the vehicle body frame 2. Grips 73 are mounted to opposite ends of the handlebars in upper portions of the pair of front forks 71. A clutch lever 74 is provided on the handlebar on the left side of the vehicle body, and a brake lever, not shown, for a front wheel 7 is provided on the handlebar on the right side of the vehicle body.

To the lower portions of the pair of front forks 71, the front wheel 7 is rotatably supported and a front fender 75 that covers the upper portion of the front wheel 7 is also placed. The front wheel 7 is provided with a brake disk 76.

A swing arm 61 is vertically swingably connected to a lower side of the rear portion of the vehicle body frame 2, and a suspension 62 for absorbing shock on the rear wheel is mounted between the vehicle body frame 2 and the swing arm 61. The rear wheel 6 is rotatably supported by the rear portion of the swing arm 61. A driven sprocket 63 is provided on the rear wheel 6, and a chain 64 is stretched between the driven sprocket 63 and a drive sprocket on the engine side. The rear wheel 6 is rotationally driven by power transmitted from the engine via the chain 64. An upper portion of the chain 64 is covered with a chain cover 65, and an upper portion of the rear wheel 6 is covered with a rear fender 66 placed on the rear side of the passenger seat 5*b*.

The engine unit 3 includes, for example, a four-cycle V-type two-cylinder engine and a transmission, and is supported by the main frame 21 via an engine mount. The engine unit 3 is a horizontal crank type in which a crankshaft is located in a vehicle width direction, and two front and rear cylinders are disposed in a V-shape arrangement in a crankcase 31 that houses the crankshaft.

Air is taken into the engine unit 3 through an intake pipe 32 (see FIG. 3), the air is mixed with fuel in a fuel injection device and supplied to a combustion chamber 355. An exhaust gas after combustion in the engine is exhausted from a muffler 34 through an exhaust pipe 33 extending downward from the engine unit 3.

A head lamp 91 is provided in front of the front fork 71, and a pair of left and right front winkers 92 are provided on opposite sides of the head lamp 91. A meter unit 93 that indicates speed, engine rpm, and fuel level is provided on an upper portion of the head lamp 91. A rearview mirror 95 is supported by the handlebar through a stay 94. A pair of left and right rear winkers 96 are provided on a rear side of the rear fender 66, and a combination lamp 97 is installed on a rear side of the rear winker 96. Further, a plurality of covers as a vehicle body exterior covers forming outer configuration are provided on the vehicle body frame 2 or the like so as to provide unity of outer appearance of the vehicle body.

With reference to FIGS. 2 to 5, the engine unit 3 including the valve train device according to the present embodiment will be described.

Figure 2:
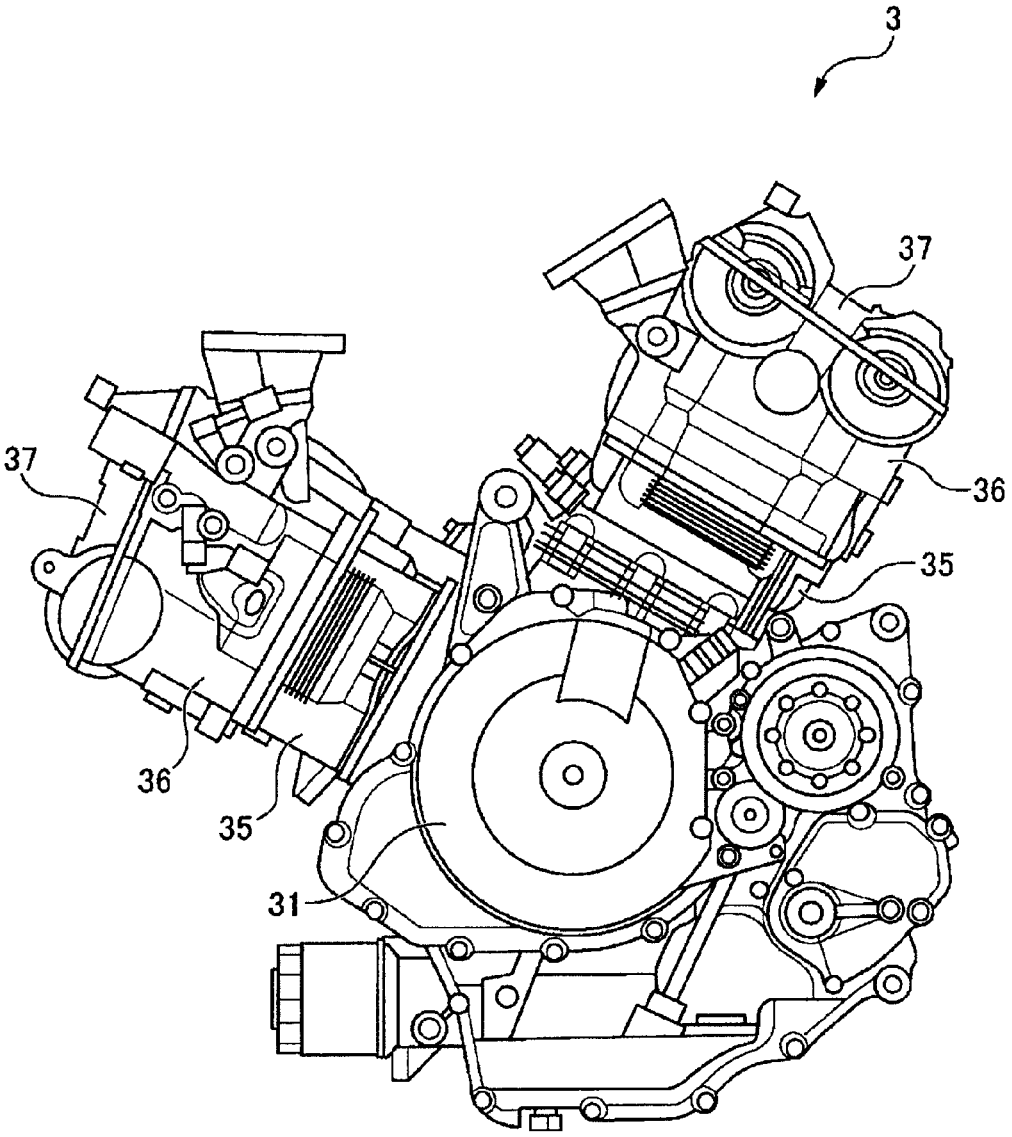
FIG. 2 is a side view of the engine unit of the motorcycle shown in FIG. 1.
Figure 3:
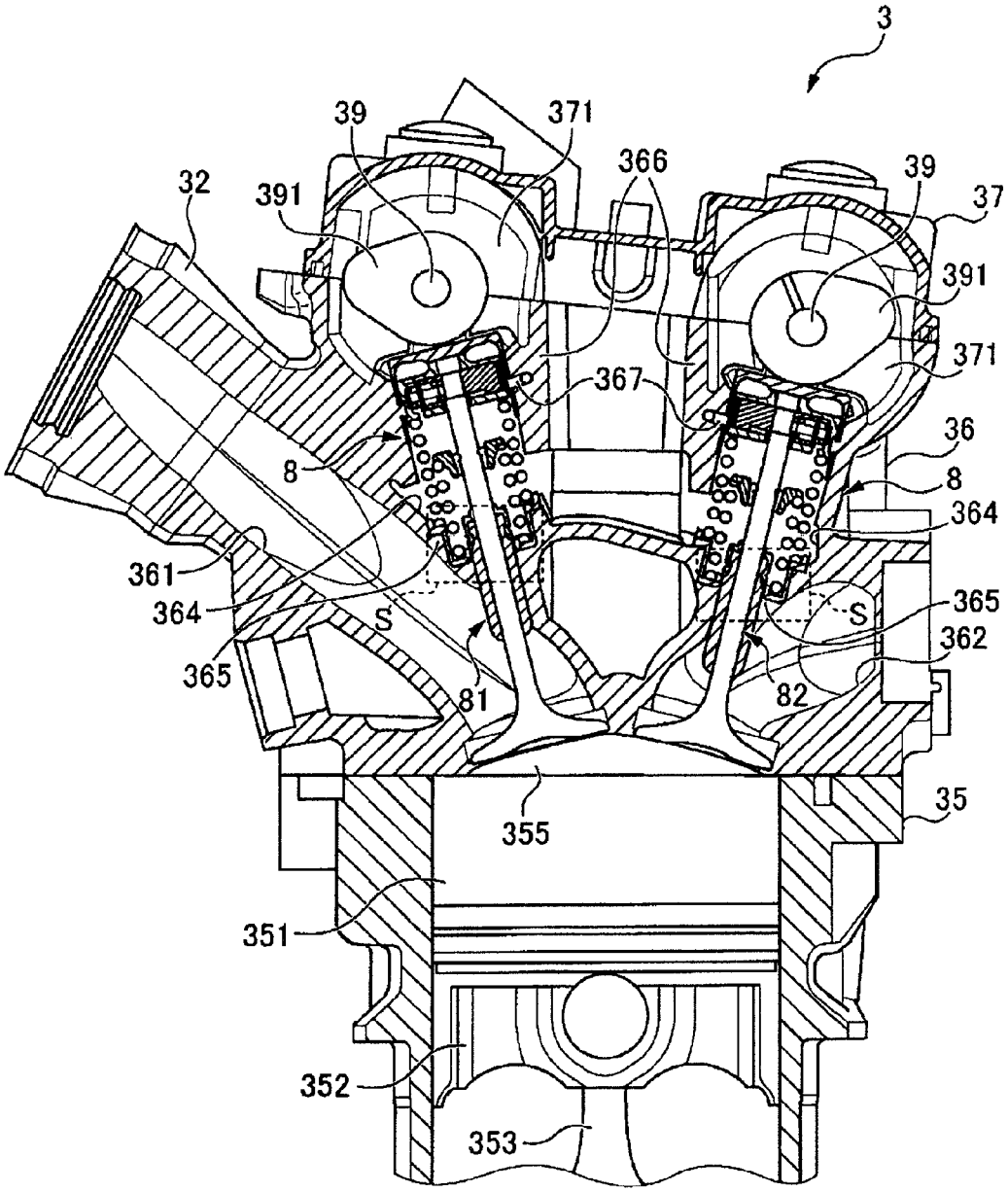
FIG. 3 is a partial sectional view of the engine unit shown in FIG. 2.
Figure 4:
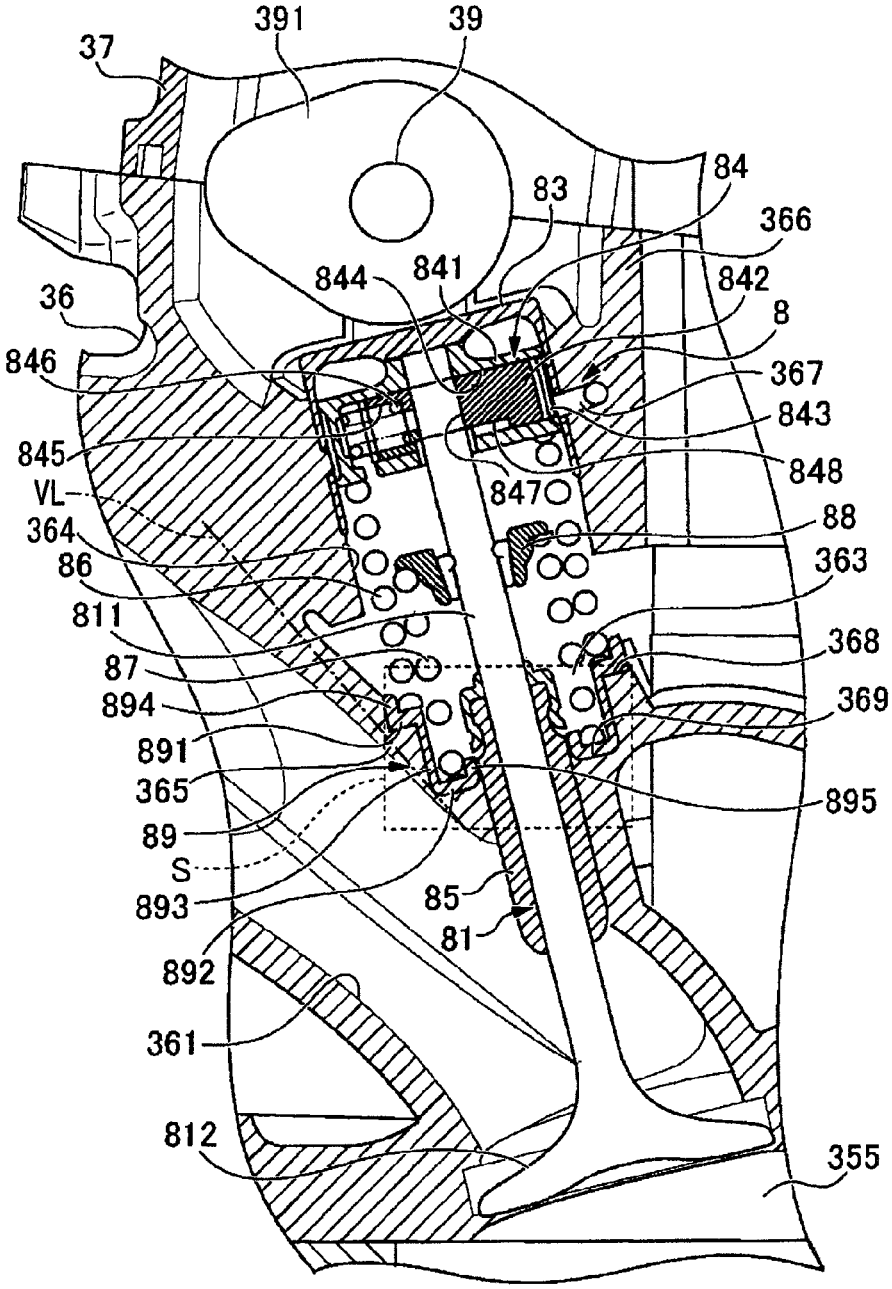
FIG. 4 is a view, in an enlarged scale, showing a valve train device of the disclosed embodiment and equipments around the valve train device on an intake side in FIG. 3.
Figure 5:
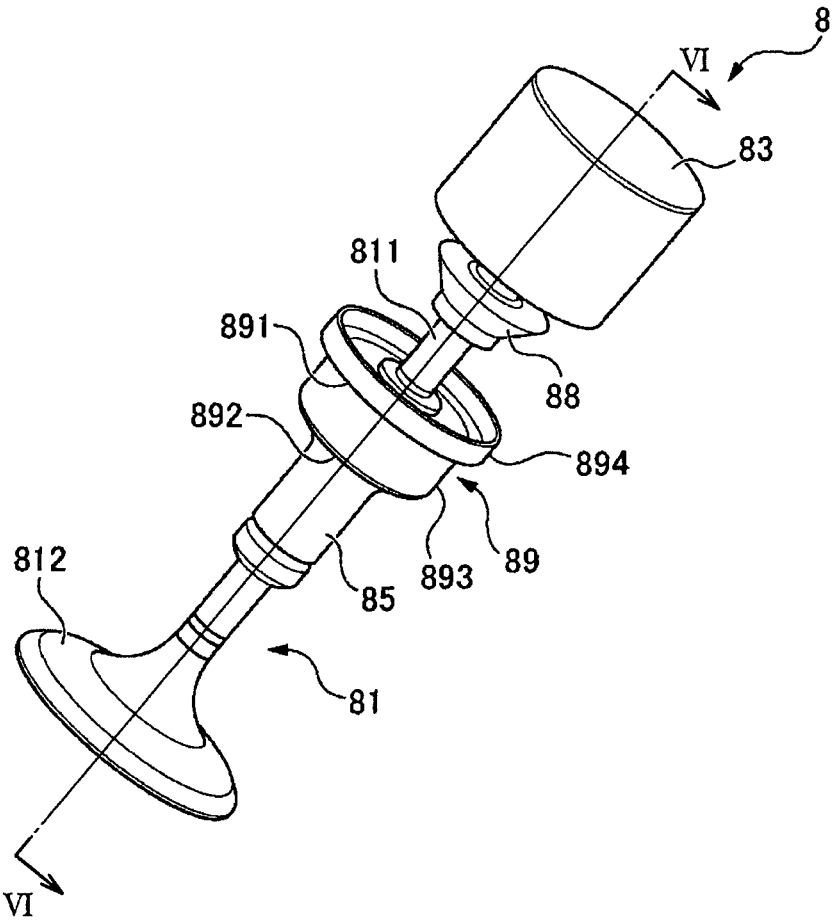
FIG. 5 is a perspective view of the valve train device shown in FIG. 4.

Further, FIG. 2 is a side view of the engine unit according to the embodiment, FIG. 3 is a partial sectional view of the engine unit, FIG. 4 is an enlarged view of the valve train device around the valve train mechanism on an intake side in FIG. 3, and FIG. 5 is a perspective view of the valve train device. In FIG. 5, an outer spring and an inner spring are omitted for the sake of convenience of the description.

As shown in FIGS. 2 and 3, the engine unit 3 has a contour configured by mounting two front and rear cylinder blocks 35 on the crankcase 31 in V-shape and mounting a cylinder head 36 and a head cover 37 to each of the cylinder blocks 35. The crankcase 31 houses the crankshaft, not shown, so as to extend in a vehicle width direction. In the cylinder block 35, a plurality of cylinder bores 351 are formed so as to be arranged laterally in the vehicle width direction, and a piston 352 is housed in each cylinder bore 351 to be vertically and reciprocally movable. The piston 352 is connected to the crankshaft via a connecting rod 353.

The cylinder head 36 includes an intake port (fluid path or passage) 361 that feeds air into the engine, and an exhaust port (fluid path or passage) 362 that delivers an exhaust gas to the outside of the engine unit. The cylinder head 36 also includes an intake valve 81 that opens/closes the intake port 361, and an exhaust valve 82 that opens/closes the exhaust port 362.

The intake port 361 and the exhaust port 362 communicate with the combustion chamber 355 defined by a lower surface of the cylinder head 36 and an upper surface of the piston 352 in the cylinder bore 351. An ignition plug, now shown, provided in the cylinder head 36 is disposed so as to protrude in an upper portion of the combustion chamber 355.

When the intake valve 81 is opened, an air/fuel mixture is fed into the combustion chamber 355 through the intake pipe 32, and the piston 352 is pressed down forcibly by ignition of the ignition plug in the combustion chamber 355. The downward movement of the piston 352 is transmitted to the crankshaft via the connecting rod 353 to swiftly rotate the crankshaft. When the piston 352 is pressed down, the exhaust valve 82 is opened and an exhaust gas is discharged from the exhaust port 362. A pair of valve train devices 8 including the intake valve 81 and the exhaust valve 82 are provided in the upper portion of the cylinder head 36.

The engine unit 3 is a direct acting DOHC (Double Over-Head Camshaft) engine, and includes a pair of camshafts 39 independently provided on the intake side and the exhaust side in a fashion corresponding to the valve train devices 8. The pair of camshafts 39 extend in the vehicle width direction in the upper portion of the cylinder head 36, and each camshaft is provided with a cam 391.

One end of each of the pair of camshafts 39 is connected to the crankshaft through a valve lifter such as a sprocket and a cam chain. The rotational motion of the crankshaft is transmitted to the pair of camshafts 39 through the valve lifter to operate the valve train devices 8 on the intake side and the exhaust side.

In the cylinder head 36, installation spaces 364 for the pair of valve train devices 8 are formed above the intake port 361 and the exhaust port 362. The installation space 364 communicates with a housing space 371 housing the camshaft 39 at an upper portion, and is partitioned by an outer wall portion 365 of the intake port 361 or the exhaust port 362 at a lower portion. The pair of valve train devices 8 are provided in the installation spaces 364 with the intake valve 81 and the exhaust valve 82 protruding into the intake port 361 and the exhaust port 362 from the outer wall portion 365.

As shown in FIGS. 4 and 5, the valve train device 8 on the intake side is configured to transmit power from the camshaft 39 to the intake valve 81 via a valve tappet 83, that is one of power transmission components such as valve lifter or valve tappet, in contact with the cam 391.

The valve tappet 83 has a cylindrical configuration having a closed upper end and an opened lower end, and is placed between an upper end of the intake valve 81 and the camshaft. A lost motion unit 84 that temporarily interrupts power transmission from the camshaft 39 to the intake valve 81 is provided in the valve tappet 83. The lost motion unit 84 is formed so as to be hydraulically switchable between an interlocking state and a non-interlocking state between the valve tappet 83 and the stem portion 811 of the intake valve 81. In the cylinder head 36, an oil passage 367 for driving the lost motion unit 84 is formed in a side wall portion 366 that supports the valve tappet 83.

The intake valve 81 includes a linearly extending stem portion 811 and an umbrella portion 812 provided at a lower end of the stem portion 811. The stem portion 811 of the intake valve 81 is passed through the valve guide 85 provided in the outer wall portion 365, and supported reciprocally movably toward the combustion chamber 355. The valve tappet 83 and the intake valve 81 are urged by the outer spring (second spring) 86 and the inner spring (first spring) 87 concentrically placed in the installation space 364. The valve tappet 83 is pressed against the camshaft 39 by the outer spring 86, and the intake valve 81 is urged in a valve closing operation direction, toward the camshaft, by the inner spring 87 via a retainer 88 secured to the stem portion 811.

In the arrangement mentioned above, the outer wall portion 365 is generally a dead space S of the cylinder block 35. An annular recess 363 is formed around the valve guide 85 of the outer wall portion 365. A bottom surface of the recess 363 is formed as a support surface 369 for the inner spring 87 formed in a position deeper than a support surface 368 for the outer spring 86. Thus, a lower end of the inner spring 87 is positioned closer to the combustion chamber 355 than a lower end of the outer spring 86 in an extending direction of the stem portion 811. Accordingly, the recess 363 is formed in the dead space S of the cylinder head 36, and thus the entire valve train device 8 is installed in a low position. In this arrangement, only the lower end of the inner spring 87 having a small diameter is located in the dead space S, thereby preventing the valve train device 8 from protruding into the intake port 361 or minimizing such protrusion thereof.

The outer spring 86 and the inner spring 87 are supported by the support surfaces 368 and 369 of the cylinder head 36 through the spring seat 89. The spring seat 89 is formed of synthetic resin or metal into a stepped cylindrical shape and mounted around the valve guide 85. The spring seat 89 includes an outer bearing surface portion 891 that receives the lower end of the outer spring 86, an inner bearing surface portion 892 that receives the lower end of the inner spring 87, and a side surface portion 893 that connects an inner peripheral edge of the outer bearing surface portion 891 and an outer peripheral edge of the inner bearing surface portion 892.

An annular holding portion 894 for retaining the outer spring 86 stands on an outer edge of the outer bearing surface portion 891, and an annular holding portion 895 for retaining the inner spring 87 stands on an inner edge of the inner bearing surface portion 892.

According to the structure mentioned above, the spring seat 89 has the outer bearing surface portion 891 and the inner bearing surface portion 892 integrally formed, and further includes the annular holding portions 894 and 895, thereby preventing the springs 86 and 87 from removing and facilitating assembly of the valve train device 8. The side surface portion 893 of the spring seat 89 is interposed between a surface on the lower end side of the inner spring 87 and the inner peripheral surface of the recess 363 in the cylinder head 36. Thus, when the intake valve 81 is driven, the surface on the lower end side of the inner spring 87 comes into slide contact with the side surface portion 893 of the inner spring 87, thereby reducing damage by wear as compared with a case of a configuration in which the surface directly comes into slide contact with the cylinder head 36.

With the valve train device 8 of the configuration mentioned above, the downward movement of the valve tappet 83 by the rotation of the camshaft 39 is transmitted to the intake valve 81 through the lost motion unit 84. At this time, when the lost motion unit 84 is in the interlocking state, the intake valve 81 is pressed downward in a valve opening direction to thereby open the intake port 361. The valve tappet 83 and the intake valve 81 pressed downward are urged backward (i.e., returned) by the outer spring 86 and the inner spring 87 so as to close the intake port 361. On the other hand, when the lost motion unit 84 is in the non-interlocking state, the power transmission to the intake valve 81 is interrupted to maintain the closed state of the valve.

As shown in FIG. 4, for example, the lost motion unit 84 includes a cylindrical plunger holder 841 mounted in the valve tappet 83 and a plunger 842 slidably held in the diametrical direction in the plunger holder 841. An upper surface of the plunger holder 841 is engaged with an upper surface of the valve tappet 83, and a lower surface of the plunger holder 841 is engaged with an upper end of the outer spring 86. Thus, the valve tappet 83 is pressed against the camshaft 39 via the plunger holder 841 by the outer spring 86. A shallow groove 843 is formed in the entire outer peripheral surface of the plunger holder 841. The oil passage 367 formed in the cylinder head 36 is connected to the shallow groove 843.

A plunger hole 844 is formed in the plunger holder 841 so as to extend in the diametrical direction thereof. The plunger hole 844 has one opened end and the other closed end, and the plunger 842 is housed therein in the slidable manner. A spring housing portion 845 cylindrically recessed from the end surface of the plunger hole 844 is formed to the end of the plunger 842 located on the closed side of the plunger hole 844. A return spring 846 that urges the plunger 842 toward the opening in the plunger hole 844 is housed between a back surface (a surface in a deep side) of the spring housing portion 845 and a back surface (a surface in a deep side) of the plunger hole 844. A through hole 847 is formed to the plunger 842 so as to be capable of entering into and out of the upper end of the stem portion 811 through the plunger 842 in the vertical direction perpendicular to the extending direction.

In the interlocking state of the lost motion unit 84, when strong hydraulic pressure is applied to the plunger 842 in the plunger hole 844 through the oil passage 367, the plunger 842 is pressed toward the back side against an urging force of the return spring 846. Then, the through hole 847 is deviated from an axis of the stem portion 811, and the upper end of the stem portion 811 faces an abutment surface 848 provided in the lower portion of the plunger 842. Thus, when the camshaft 39 vertically moves the valve tappet 83, the abutment surface 848 of the plunger 842 abuts against the upper end of the stem portion 811 to thereby interlock the valve tappet 83 and the intake valve 81.

In the non-interlocking state, on the other hand, when the hydraulic pressure on the plunger 842 in the plunger hole 844 is reduced, the plunger 842 is pressed back side by the biasing force of the return spring 846. The hydraulic pressure at this time is adjusted so that the through hole 847 is positioned on the axis of the stem portion 811. Thus, even if the valve tappet 83 is moved vertically by the camshaft 39, the upper end of the stem portion 811 merely is moved into and out of the through hole 847, thereby releasing the interlocking between the valve tappet 83 and the intake valve 81. Accordingly, the lost motion unit 84 can interrupt the power transmission from the valve tappet 83 to the intake valve 81.

Instead of the structure or arrangement in which the through hole 847 is positioned on the axis of the stem portion 811 by the level of the hydraulic pressure, the plunger 842 pressed backward by the return spring 846 may be positioned by a positioning member or the like. The lost motion unit 84 is not limited to the above configuration and may take any mechanism configuration that can interrupt the power transmission from the valve tappet 83 to the intake valve 81. The valve train device 8 on the exhaust side has substantially the same configuration and arrangement as those of the valve train device 8 on the intake side, and the description thereof will be omitted herein.

Figure 6:
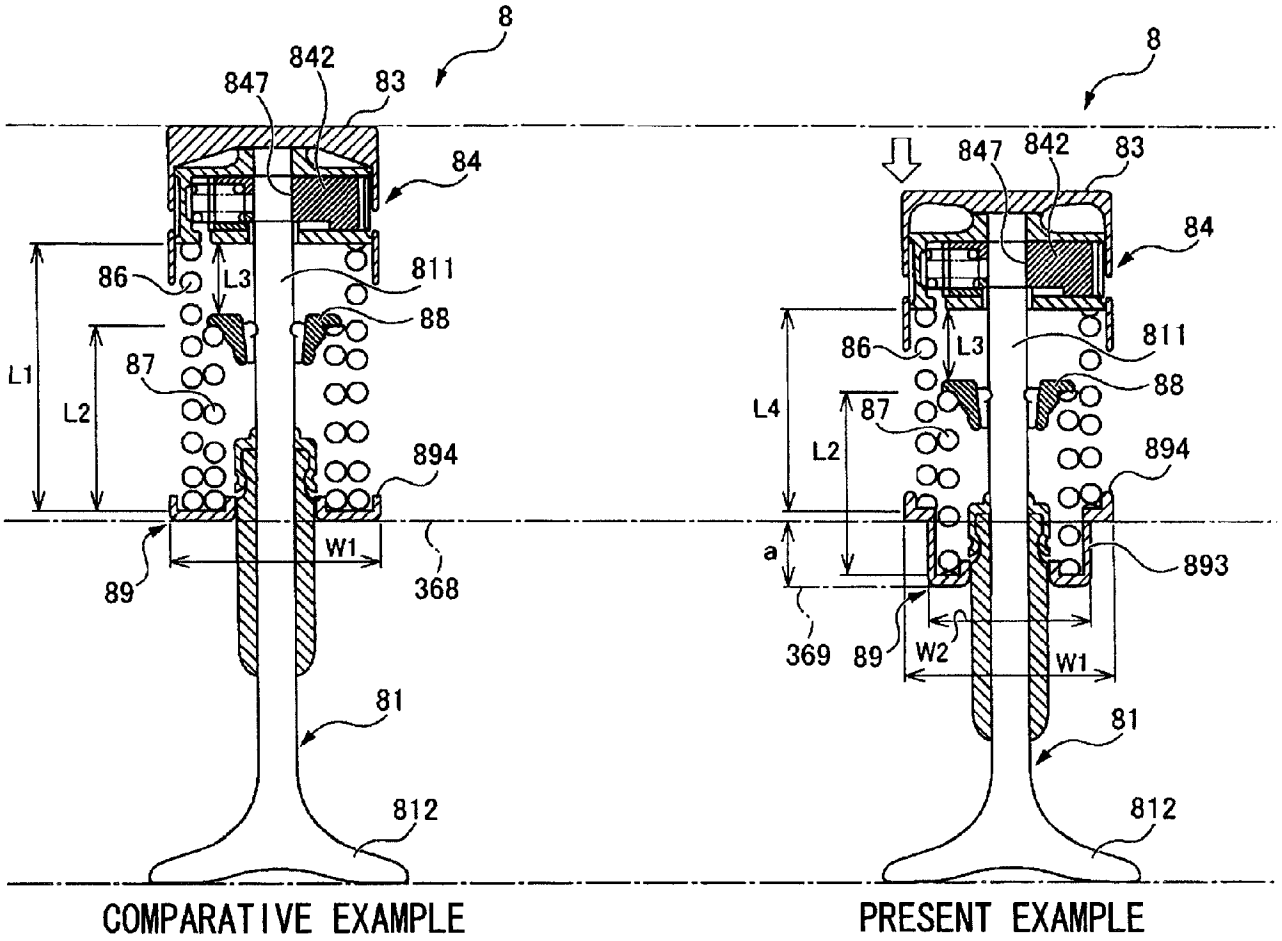
FIG. 6 illustrates a sectional view of the valve train device according to the disclosed embodiment shown in FIG. 4 and a comparative example taken along the line VI-VI of FIG. 5.

With reference to FIG. 6, an installed structure of the valve train device on the intake side will be described. FIG. 6 illustrates the installed structure or arrangement of the valve train device according to the present embodiment. In the illustration on FIG. 6, the right side represents the valve train device according to one disclosed embodiment and the left side view represents a valve train device according to a comparative example.

The valve train device according to the comparative example is different from the valve train device according to the present embodiment on the right side in that an outer spring and an inner spring are supported by the same support surface. In the comparative example, the same terms as in the embodiment are denoted by the same reference numerals for the sake of easy understanding of the explanation. The valve train device on the exhaust side has substantially the same installed structure or configuration as that of the valve train device on the intake side, and the description thereof is hence omitted herein.

As shown in FIG. 6, in a valve train device 8 according to the comparative example (left side illustration), an outer spring 86 and an inner spring 87 are supported by the same support surface 368 of the cylinder head 36. A length L1 of the outer spring 86 is longer than a length L2 of the inner spring 87, and the lost motion unit 84 is spaced by a distance L3 from a retainer 88 secured to a stem portion 811. The distance L3 ensures a moving length of the stem portion 811 into and out of a through hole 847 in a plunger 842 during a lost motion, thereby providing establishment of the non-interlocking state between a valve tappet 83 and an intake valve 81.

As mentioned above, the lost motion unit 84 provided in the valve train device 8 of the comparative example increases a size of the valve train device 8 in a driving direction of the intake valve 81. According to this increase in the size, components such as the cylinder head 36 and a head cover 37 that house the valve train device 8 are also increased in size, hence increasing the height of the engine. Thus, the valve train device 8 according to the comparative example requires a dedicated component corresponding to an increase in size of the valve train device, thereby increasing production costs. In the arrangement of FIG. 6, a long stem portion 811 of the intake valve 81 needs to be formed to achieve the lost motion.

On the other hand, in the valve train device 8 according to the embodiment (right side illustration), the outer spring 86 is supported by the support surface 368, and the inner spring 87 is supported by the support surface 369 in a position deeper than the outer spring 86. Thus, the outer spring 86 having a length L4 shorter than the length L1 of the outer spring 86 in the comparative example can ensure a distance L3 between the retainer 88 and the lost motion unit 84. Specifically, the length of the outer spring 86 can be reduced by a distance "a" between the support surface 368 and the lower end of the inner spring 87 as compared to the comparative example.

Therefore, in the valve train device 8 according to the present embodiment, the length of the outer spring 86 can be reduced, and thus, the valve tappet 83 and the lost motion unit 84 can be placed at a low position. This arrangement can contribute to absorb an increase in size of the valve train device 8 by the lost motion unit 84 and to prevent an increase in height of the engine unit. Further, the need for a dedicated component due to the increase in height of the engine unit is eliminated, resulting in the reduction of the production costs. According to the present embodiment, as shown in right side illustration of FIG. 6, the valve tappet 83 and the lost motion unit 84 are placed in a low position, and thus, a stem portion 811 having short length can be formed, and for example, the intake valve 81 of the valve train device 8 without the lost motion unit 84 can be used.

In the valve train device 8 according to the present embodiment, since the lower end of the inner spring 87 is positioned closer to the umbrella portion 812 than the lower end of the outer spring 86 and supported by a stepped cylindrical spring seat 89, in a contour on the lower end side of the valve train device 8, a width W2 defined by the side surface portion 893 at the lower end of the inner spring 87 can be formed to be narrower than a width W1 defined by the annular holding portion 894 at the lower end of the outer spring 86. Accordingly, in the valve train device 8 of the present embodiment, the installation portion (specifically, a region from the valve tappet 83 to the spring seat 89) in the cylinder head 36 is narrower on the lower end side than the upper end side of the stem portion 811. Thus, as shown in FIG. 4, even if a narrow dead space S of the cylinder head 36 is formed, the valve train device 8 can be prevented from protruding into the intake port 361 or minimizing the protruding distance, thus being advantages and effective.

As described above, according to the valve train device 8 of the disclosed embodiment, the end of the inner spring 87 having a diameter smaller than that of the outer spring 86 is disposed in the dead space S of the cylinder head 36, thereby preventing the springs 86 and 87 from protruding into the intake port 361 and the exhaust port 362 or minimizing the protrusion entering therein, and preventing an increase in height of the engine with a simple configuration, thereby absorbing an increase in size of the valve train device 8 by the lost motion unit 84, and preventing an increase in height of the engine (engine unit). Therefore, an installation space for the engine unit can be ensured, and the weight of the engine can be reduced. Further, a location of dedicated component due to the increase in height of the engine is not needed, so that the production costs can be reduced.

It is to be noted that the present invention is not limited to the embodiment disclosed above, and many other changes and modifications or alternations may be made without departing from the scopes of the appended claims, and in addition, the size or shape is not limited to that shown in the accompanying drawings, and may be changed within the scope of the advantage of the present invention.

Figure 7:
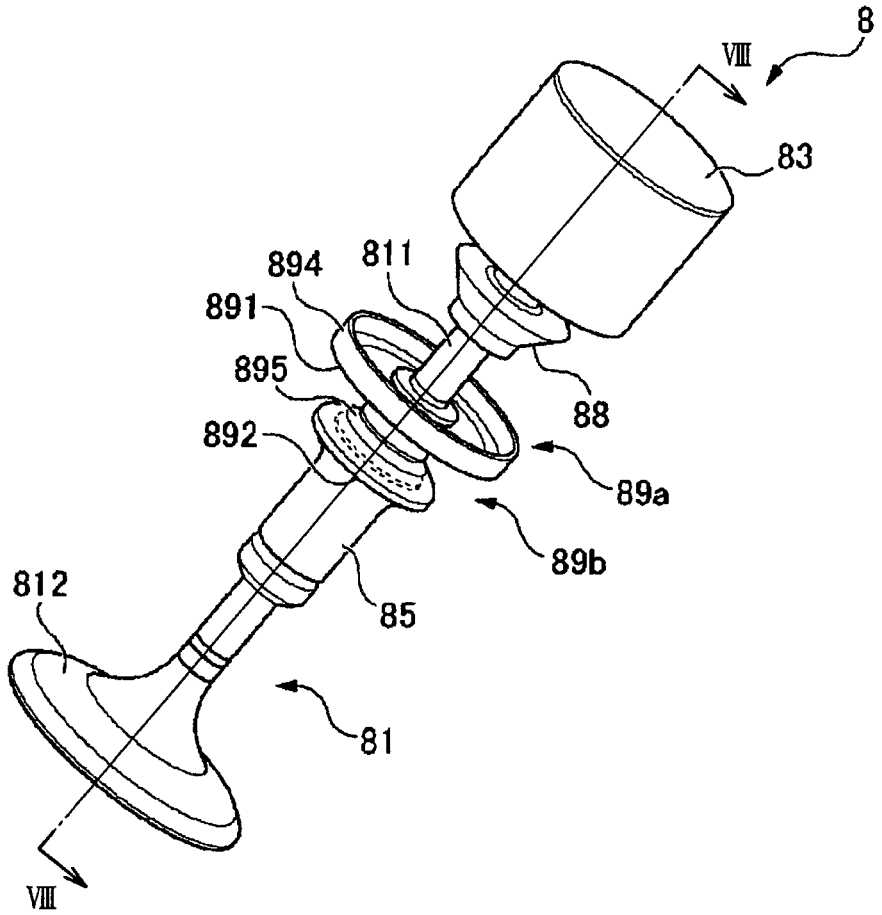
FIG. 7 is a perspective view of a modified example of the valve train device according to another disclosed embodiment.
Figure 8:
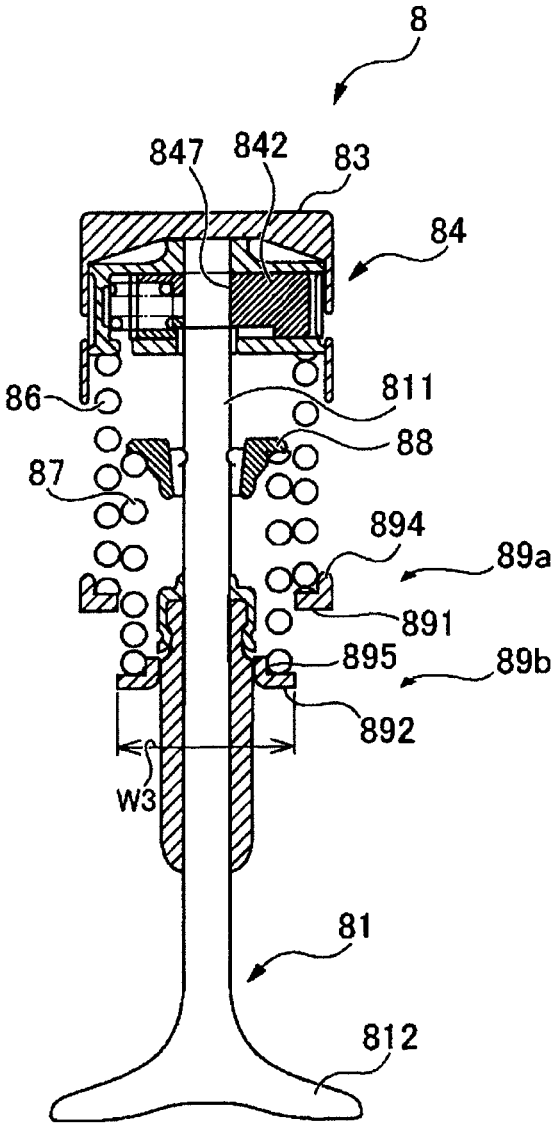
FIG. 8 is a sectional view of the valve train device of the disclosed embodiment shown in FIG. 7 taken along the line VIII-VIII of FIG. 7.

For example, although the valve train device 8 according to the present embodiment includes the spring seat 89 having the outer bearing surface portion 891 and the inner bearing surface portion 892 integrally formed, a separately formed spring seat may be provided as in a valve train device 8 as a modified example such as shown in FIGS. 7 and 8, in which the valve train device is different from the valve train device according to the described embodiment only in the separately formed spring seat.

That is, only the difference will be particularly described hereunder. FIG. 7 is a perspective view of a valve train device according to a modified example, and FIG. 8 is a sectional view of the valve train device of the modified example. In the modified example, the same terms as in the embodiment are denoted by the same reference numerals.

As shown in FIGS. 7 and 8, the valve train device 8 according to the modified example includes a spring seat (second spring seat) 89*a* for an outer spring 86, and a spring seat (first spring seat) 89*b* for an inner spring 87. The spring seat 89*a* includes an outer bearing surface portion 891 that receives a lower end of the outer spring 86 and a retaining annular holding portion 894 standing on an outer edge of the outer bearing surface portion 891. The spring seat 89*b* includes an inner bearing surface portion 892 that receives the lower end of the inner spring 87 and a retaining annular holding portion 895 standing on an inner edge of the inner bearing surface portion 892. Specifically, the spring seats 89*a* and 89*b* have configurations of the spring seat 89 with the side surface portion 893 removed, and a surface of the lower end of the inner spring 87 is exposed between the spring seats 89*a* and 89*b*.

An outer configuration of the lower end side of the valve train device 8, the side surface portion 893 surrounding the inner spring 87 is not provided, and thus, a width W3 is defined by the outer peripheral surface of the inner spring 87. According to such arrangement of the modified example, in the lower end of the inner spring 87, a smaller width can be obtained in comparison with the width W2 defined by the side surface portion 893 in the above-described embodiment because of no thickness of the side surface portion 893. Therefore, in the valve train device 8, the installation portion in the cylinder head 36 is made to be narrower on the lower end side than the upper end side of the stem portion 811. Thus, even if a narrow dead space S of the cylinder head 36 is formed, protrusion of the valve train device 8 into the intake port 361 can be prevented or minimized.

As described hereinbefore, according to another disclosed embodiment, there is provided a valve train device installed in a cylinder head of an engine and driven by a camshaft of the engine. The valve train device includes a valve unit including an intake valve and an exhaust valve communicated with a combustion chamber of an engine, each of the intake valve and exhaust valve having a linearly extending stem portion and driven in an extending direction of the stem portion to open/close an intake port or exhaust port communicating with the combustion chamber; a valve lifter as a power transmission mechanism disposed between one end side of the stem portion located apart from the combustion chamber and the camshaft so as to transmit power from the camshaft to the valve unit; and a lost motion unit that interrupts power transmission from the valve lifter to the valve unit. The valve train device further includes a first spring urging the valve unit in a direction to close the intake valve or exhaust valve, and a second spring having a diameter larger than that of the first spring and urging the lost motion unit against the valve lifter, in which another end side of the second spring is disposed at a portion closer to one end side of the stem portion than a location of another end side of the first spring with respect to the cylinder head.

According to the disclosed embodiment, there is also provided a cylinder head of an engine provided with an intake port and an exhaust port, and includes an intake valve and an exhaust valve to open/close the intake port and the exhaust port, and a valve train device that drives the intake valve and/or exhaust valve. The valve train device includes a valve unit and other components mentioned above, wherein the cylinder head is provided with an inner bearing surface portion to which the first spring is fitted and an outer bearing surface portion to which the second spring is fitted, in which the outer bearing surface portion is positioned closer to the valve lifter than the inner bearing surface portion, and the inner bearing surface portion and the outer bearing surface portion have configuration such that a virtual line (VL in FIG. 4) connecting an outer edge portion of the inner bearing surface portion and an outer edge portion of the outer bearing surface portion is substantially parallel to an inner peripheral wall surface of the intake port or exhaust port as viewed in an axial direction of the valve unit.

According to the cylinder head of an engine provided with a valve train device of the structure mentioned above can provide advantageous effects and/or functions as those mentioned with reference to the valve train device.

What is claimed is:

1. A valve train device installed in a cylinder head of an engine and driven by a camshaft of the engine, the valve train device comprising:

a valve unit including an intake valve and an exhaust valve communicated with a combustion chamber of an engine, each of the intake valve and exhaust valve having a linearly extending stem portion and being driven in an extending direction of the stem portion to open/close an intake port or exhaust port communicating with the combustion chamber of the engine;

a valve lifter disposed between a first end side of the stem portion located apart from the combustion chamber and the camshaft so as to transmit power from the camshaft to the valve unit;

a lost motion unit that interrupts power transmission from the valve lifter to the valve unit;

a first spring having a first and second end and urging the valve unit in a direction to close the intake valve or exhaust valve; and a second spring having a first and second end and a diameter larger than that of the first spring and urging the lost motion unit against the valve lifter, wherein the first end side of the second spring is disposed at a portion closer to the first end side of the stem portion than a location of the first end side of the first spring with respect to the cylinder head, wherein the first spring and the second spring have respective first and second spring seats, wherein the first spring seat has an outer bearing surface portion that receives the second end of the second spring on the other end side in the extending direction of the stem portion, and the second spring seat has an inner bearing surface portion that receives an end of the first spring on the other end side in the extending direction of the stem portion, and wherein the first spring has an end surface portion exposed between the first spring seat and the second spring seat, the valve train device further comprising a valve guide mounted around the stem portion so as to guide the stem portion, wherein a stepped annular recess is formed around the valve guide of an outer wall portion of the intake port and the second end of the first spring is disposed in the stepped annular recess, wherein the first and second spring seats are integrally formed so as to form a stepped cylindrical shape that is mounted to the stepped annular recess of the wall portion of the intake port and mounted around the valve guide, and wherein a lower end of the first spring is positioned closer to an umbrella portion, which is positioned at the other end side in the extending direction of the stem portion, than a lower end of the second spring.

2. The valve train device according to claim 1, wherein the first spring is installed in the cylinder head through the first spring seat.

3. A cylinder head of an engine comprising:

an intake port;

an exhaust port;

a valve unit including an intake valve and an exhaust valve to open/close the intake port and the exhaust port; and a valve train device that drives the valve unit, wherein the valve train device includes a cam shaft, a valve lifter driven by a cam mounted to the cam shaft to be integrally rotatable, a lost motion unit that interrupts power transmission from the valve lifter to the valve unit, a first spring urging the valve unit in a direction to close the intake valve or exhaust valve, and a second spring having a diameter larger than that of the first spring and urging the lost motion unit against the valve lifter, and wherein the cylinder head is provided with an inner bearing surface portion to which the first spring is fitted and an outer bearing surface portion to which the second spring is fitted, in which the outer bearing surface portion is positioned closer to the valve lifter than the inner bearing surface portion, and the inner bearing surface portion and the outer bearing surface portion have configuration such that a virtual line connecting an outer edge portion of the inner bearing surface portion and an outer edge portion of the outer bearing surface portion is substantially parallel to an inner peripheral wall surface of the intake port or exhaust port as viewed in an axial direction of the cam shaft, wherein the first spring and the second spring have respective first and second spring seats, wherein the first spring seat has an outer bearing surface portion that receives the second end of the second spring on the other end side in the extending direction of the stem portion, and the second spring seat has an inner bearing surface portion that receives an end of the first spring on the other end side in the extending direction of the stem portion, and wherein the first spring has an end surface portion exposed between the first spring seat and the second spring seat, the valve train device further comprising a valve guide mounted around the stem portion so as to guide the stem portion, wherein a stepped annular recess is formed around the valve guide of an outer wall portion of the intake port and the second end of the first spring is disposed in the stepped annular recess, wherein the first spring seat is mounted around the valve guide and a stepped annular recess is formed around the valve guide of an outer wall portion of the intake port and the second end of the first spring is disposed in the stepped annular recess, wherein the first and second spring seats are integrally formed so as to form a stepped cylindrical shape that is mounted to the stepped annular recess of the wall portion of the intake port and mounted around the valve guide, and wherein a lower end of the first spring is positioned closer to an umbrella portion, which is positioned at the other end side in the extending direction of the stem portion, than a lower end of the second spring.

4. The valve train device according to claim 1, wherein the spring seat is provided with an annular holding portion.

* * * * *